US005813956A

United States Patent [19]

Iams et al.

[11] Patent Number: 5,813,956

[45] Date of Patent: Sep. 29, 1998

[54] SHOULDER EXERCISER

[75] Inventors: John F. Iams, Poway; Robson L. Splane, Jr., Granada Hills, both of Calif.

[73] Assignee: Superspine, Inc., Poway, Calif.

[21] Appl. No.: 613,369

[22] Filed: Mar. 11, 1996

Related U.S. Application Data

[62] Division of Ser. No. 76,551, Jun. 11, 1993, Pat. No. 5,498, 223.

[51] Int. Cl.[6] ..... A63B 23/02

[52] U.S. Cl. ..... 482/129; 482/121; 482/904

[58] Field of Search ..... 482/904, 92, 148, 482/93, 121–129, 140, 907

[56] References Cited

U.S. PATENT DOCUMENTS 5,342,274 8/1994 Hunker ..... 482/140
5,366,427 11/1994 Price, II ..... 482/92

*Primary Examiner*—Jerome Donnelly
*Attorney, Agent, or Firm*—Stanley A. Becker

[57] ABSTRACT

A shoulder exerciser which allows a user to exercise a shoulder includes a handpiece which is movable on a surface such as a floor or door against a variable resistance. The shoulder exerciser includes a handpiece and a plurality of resilient members connected thereto. The resilient members are connected to a door or a platform so that the handpiece can be moved in a prescribed exercise against the resistance of the resilient members. The resistance is variable by adjusting the length of each resilient member.

8 Claims, 3 Drawing Sheets

SHOULDER EXERCISER

This application is a divisional application of Ser. No. 08/076,551 filed Jun. 11, 1993 now U.S. Pat. No. 5,498,223.

BACKGROUND OF THE INVENTION

I. Field of the Invention

This invention relates to a shoulder exerciser for providing a user a wide and variable range of motion to exercise a shoulder and, more particularly, to a shoulder exerciser having a handpiece which can be used along any surface, either vertical, horizontal or inclined, against a variable resistance to allow specific exercises to be performed to exercise the shoulder.

II. Description of Related Art

Many people suffer from shoulder problems which are responsive to exercise or physical therapy. Depending on the specific shoulder problem, various exercises have been found to be of more value than others. For example, professionals have prescribed exercises such as placing a hand on a wall and making a window washing motion.

At the present time, no shoulder exerciser device exists to allow a user to implement a variety of different exercises by moving a handpiece against a predetermined and adjustable resistance. It would be of considerable value to have a shoulder exercise device which is a simple structure allowing a user to exercise his or her shoulder in a variety of exercises and under variable resistance. Furthermore, it is desirable to be able to perform such exercises in ones own home or office.

SUMMARY OF INVENTION

The present invention relates to a new and novel shoulder exerciser which includes a handpiece or handle upon which a user places one or both hands. The handpiece has a bottom surface which allows it to slide against a door, floor or other surface.

An elongated resilient member or a plurality of resilient members are attached to the handpiece. The elongated resilient member can be placed around a door. If a plurality of resilient members are used, one end of each resilient member is attached to the handpiece and the other end of each resilient member is attached to a clip or other means for securing it to a platform or the corners of a door as will be more fully described hereinafter. The resilient members can be a rubber band, surgical tubing, bungie cord or the like and are adjustable so that the resistance a user experiences when moving the handpiece can be varied and controlled. The resistance is light and fluid to encourage compliance by the patient. The subject invention is easy to use and is appropriate for passive as well as active modes of exercise.

In its simplest form, the shoulder exerciser handpiece has each end of an elongated resilient member attached to it. The resilient member is placed around the top and bottom of a door. The resilient member is adjusted by rotation to place the handpiece at a comfortable position on the door. The user then moves the handpiece along the door up and down, side to side, angularly, or in a rotary movement to carry out prescribed shoulder exercises. The handpiece can have a hollow cavity and a removable cap which allows weight to be put into the hollow cavity. Either water, sand or leadshot can be used to fill the hollow cavity to provide weight for a more rigorous exercise. The handpiece may also be provided with a handle.

In use on a door, the shoulder exerciser is positioned against the face of a door. The elastic resistance member or members are stretched around the top and bottom of the door or connected to the corners of the door and the door is closed. The flat side of the handpiece is positioned against the door surface. The resistance members are adjusted to position the handpiece at the desired height on the door and to provide the desired resistance. To adjust the resistance, one end of the elastic resistance member is shortened to increase the resistance or lengthened to decrease the resistance.

Typically, the user will stand facing the door and use one hand to move the shoulder exerciser in the direction prescribed by the health care professional or in any direction that the user feels comfortable in the avoidance of pain. For a wider range of motion, the same exercises can be performed by simply moving the body to a side position with the shoulder being exercised located adjacent to the door.

Passive modes of exercise can also be performed by moving the handpiece with both hands for this mode of exercise. The uninvolved arm is used to power or move the handpiece while the injured arm and shoulder moves in a passive mode.

The shoulder exerciser can also be used while seated adjacent to a door. Furthermore, the shoulder exerciser can also be placed on a tabletop, countertop or floor for similar exercises. Additionally, the shoulder exerciser can be used on the floor in combination with rotatable knee pads to exercise the shoulders and trunk simultaneously.

DETAILED DESCRIPTION OF THE INVENTION

The following description is of the best presently contemplated modes of carrying out the inventions. This description is made for the purpose of illustrating the general principals of the invention and should not be taken in a limiting sense.

Figure 1:
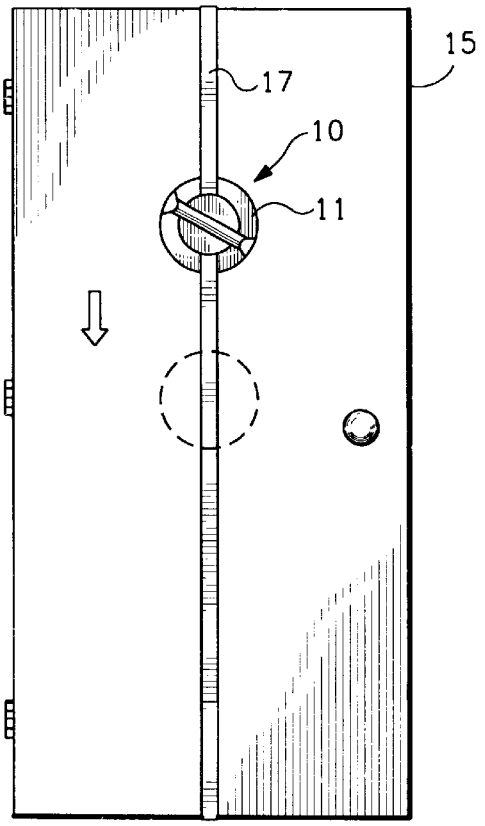
FIG. 1 is a front view illustrating the shoulder exerciser mounted to a door.
Figure 2:
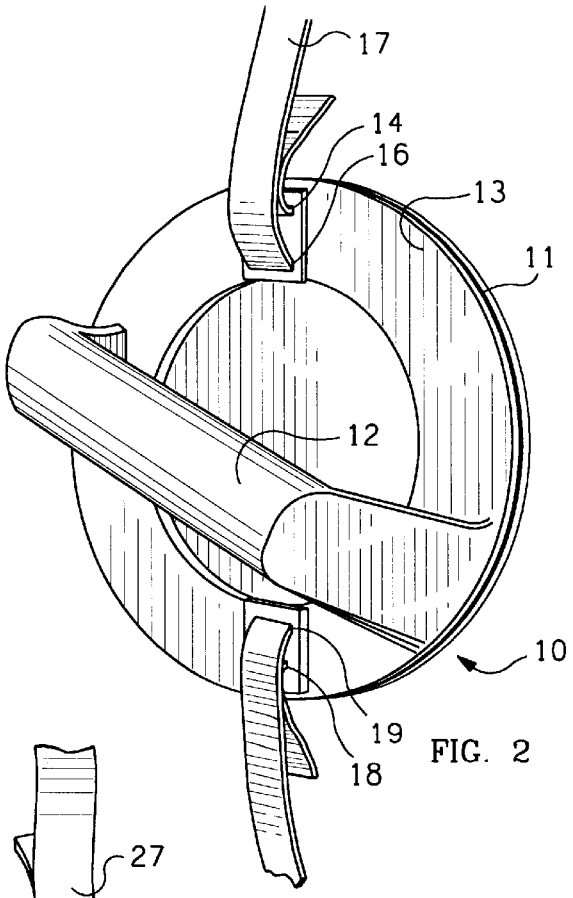
FIG. 2 is a perspective view of the shoulder exerciser shown in FIG. 1.

In accordance with the present invention, there is shown in FIGS. 1 and 2 a shoulder exerciser generally designated as 10 attached to a door 15. The shoulder exerciser includes a handpiece 11 having a handle 12 attached thereto or formed integrally therewith. The bottom of the handpiece has a felt pad (not shown) attached at least under the flat portion 13 of the handpiece to allow it to slide easily on a door or other surface. The handpiece has a pair of slots 14 and 16 formed therein to receive one end of a resilient member 17. Another pair of slots 18 and 19 are formed opposite the first pair of slots to receive the other end of the resilient member 17. The slots permit the resilient member to be adjustable so that the resilient member can provide a an infinitely variable resistance to motion. The resilient member is shown in FIGS. 1 and 2 as being an elongated flat rubber band. However, the resilient member could be surgical tubing, a bungie cord or the like. Additionally, while the means for adjustment of the resilient member is shown to be a pair of slots, other adjustment means are well known in the art and could be incorporated into the design of the handpiece and utilized therewith.

In use, the resilient member of the shoulder exerciser is placed around the top and bottom of a door. The handpiece 11 is positioned at a comfortable height for the user and the door is closed. The resistance of the resilient member is adjusted by shortening or lengthening the ends of the resilient member through the pairs of slots 14 and 16 and 18 and 19. A user can then perform any number of different exercises including moving the handpiece 11 side to side, moving it up and down, or moving it in a rotary motion, or any variation thereof to exercise the shoulder. If increased resistance is desired, the resilient member 17 can be tightened. If less resistance is desired, the resilient member 17 can be loosened.

Figure 3:
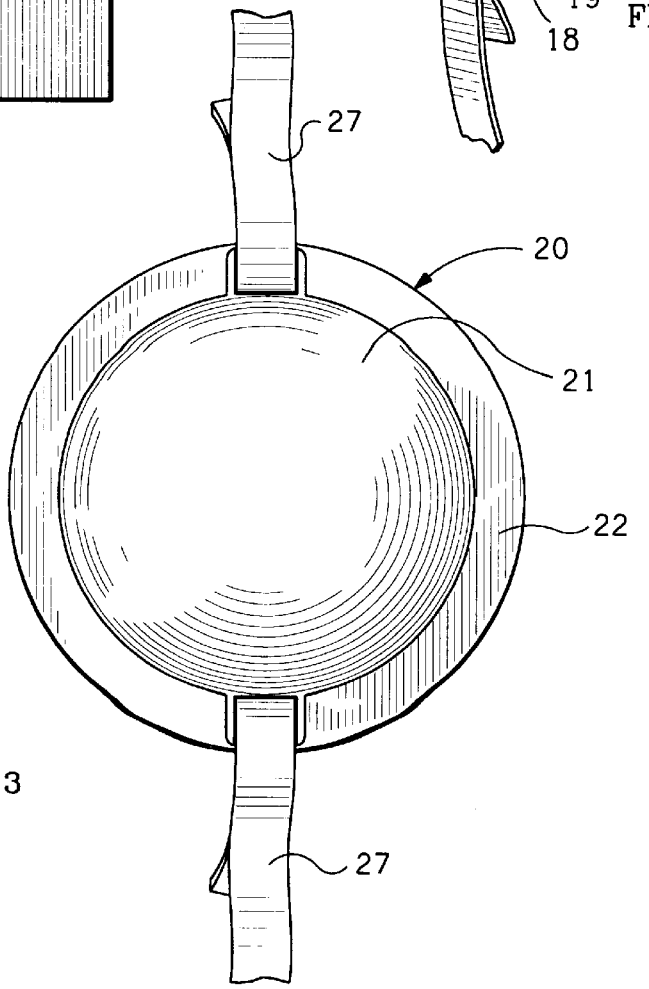
FIG. 3 is an alternative embodiment showing a dome shaped shoulder exerciser.
Figure 4:
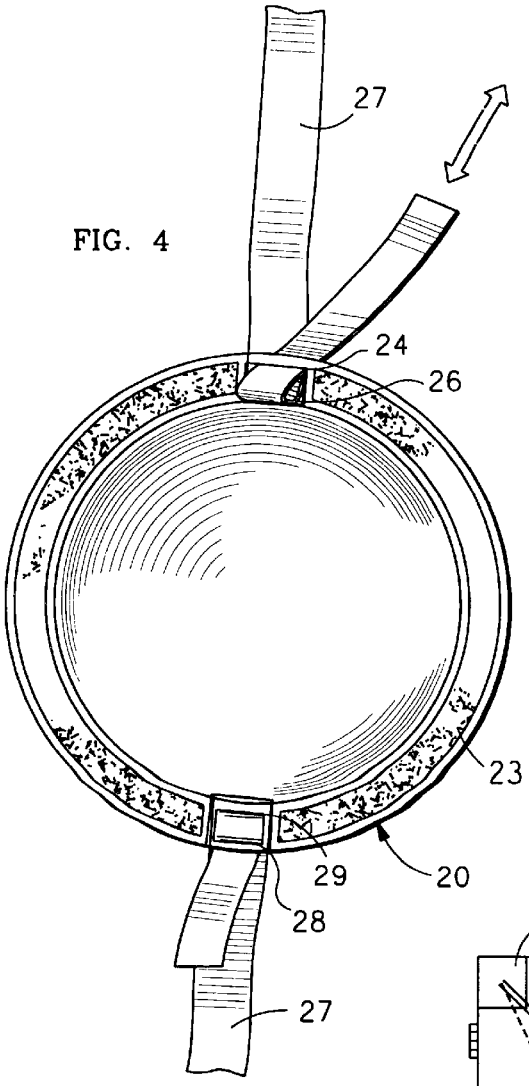
FIG. 4 is a bottom view of the shoulder exerciser of FIG. 3.

Referring to FIGS. 3 and 4, there is shown an alternative embodiment of the shoulder exerciser generally designated as 20 which includes a dome shaped handle 21 having a flat circumferential portion 22 which slides against the face of a door or other surface. The dome shaped handpiece easily accommodates either one or both hands. The handle 12 of the handpiece 11 shown in FIGS. 1 and 2 is comfortable for exercising the right shoulder in the position shown but should be reversed for comfortable exercise of the left shoulder. The dome shaped handle 21 does not require this.

FIG. 4 shows the underside of the handpiece 20 and illustrates the adhesive backed felt pads 23 which facilitates the sliding of the handpiece 20 on the surface of the door or floor. Similarly, handpiece 20 has slots 24 and 26 to receive one end of resilient member 27 and to permit adjustment of the resistance. On the opposite side of the handpiece 20 are slots 28 and 29 to receive the other end of the resilient member 27.

Figure 5:
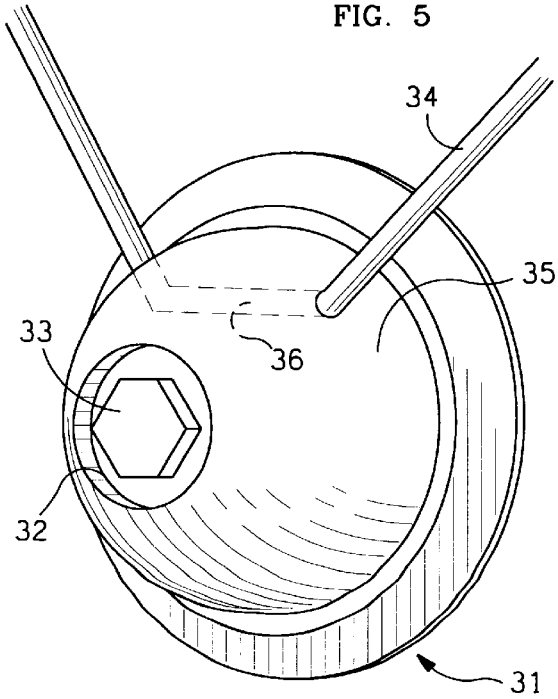
FIG. 5 is a perspective view of a dome shaped shoulder exerciser having a hollow cavity for receiving weight.
Figure 6:
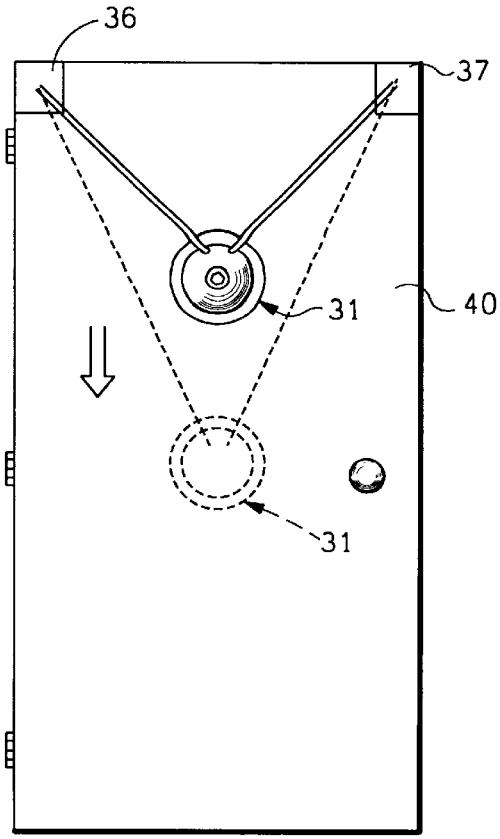
FIG. 6 is a view of the shoulder exerciser of FIG. 5 attached to a door.

FIGS. 5 and 6 show another embodiment of a dome shaped handpiece generally designated as 31 having a dome shaped portion 35 having a recess 32 in the top thereof with a removable threaded cap 33. The dome shaped portion 35 is hollow and is sealed at the bottom (not shown) to provide a cavity into which water, sand, leadshot or the like can be inserted for providing weight to the handpiece to increase the force required to perform an exercise. The handpiece 31 is slightly different than the previous handpieces shown in FIGS. 1 to 4 in that it has a resilient member 34 which passes through an opening 36 in the handpiece and has its outer ends connected to door clips 36 and 37 which are described more fully hereinafter. The door clips 36 an 37 are connected to the upper corners of a door 40.

Figure 7:
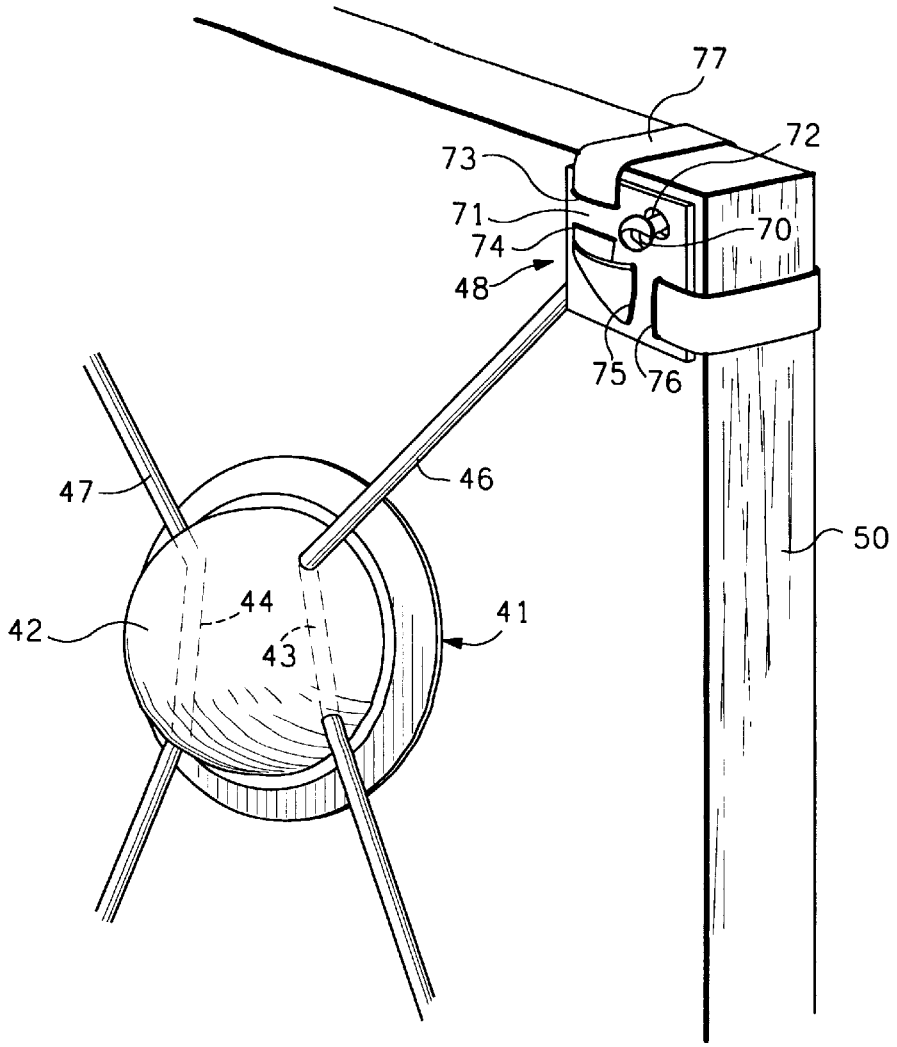
FIG. 7 is a perspective view of another embodiment of a shoulder exerciser attached to a corner of a door by a door clip.

Referring to FIG. 7, there is shown another alternative embodiment of the shoulder exerciser which is generally designated as 41. This embodiment has a dome shaped handle 42 and a plurality of passageways 43 and 44 to receive two resilient members 46 and 47, the ends of which are connected to the four corners of a door 50. The passageways are formed such that there is frictional contact with the resilient members by the size of the passageway or the direction thereof. In other words, the angular direction the resilient member takes toward the corner of the door will create sufficient frictional contact to permit adjustment of the handpiece and to hold it in place once adjusted. The resilient member 46 has one end connected to a clip 48 attached to one corner of the door. The other end of the resilient member 46 passes through opening 43 and is also connected to the bottom of the door by a similar clip not shown. Similarly, resilient member 47 passes through opening 44 and is connected at either end to a pair of clips (not shown) at the left corners of the door. The handpiece can be adjusted by moving it up or down to any desired position for a comfortable location on the door prior to beginning exercise. The clip 48 includes a pair of plastic or metal plates 71 (only one of which is shown) on each side of the door 50. The plate 71 has a keyhole opening 72 for securing a knotted or enlarged end 70 of resilient member 46. Other well known means of securing the end 70 to the plate 71 could also be used. A plurality of slots 73, 74, 75 and 76 are formed in the plate 71 to receive a web 77 which interconnects both plates 71. The web 77 is sufficiently thin to allow closure of the door 50 after installation.

While the shoulder exerciser has been described thus far as being attachable to a door, it can also be adapted for use on a table, floor, or any other flat surface, including an inclined surface.

Figure 8:
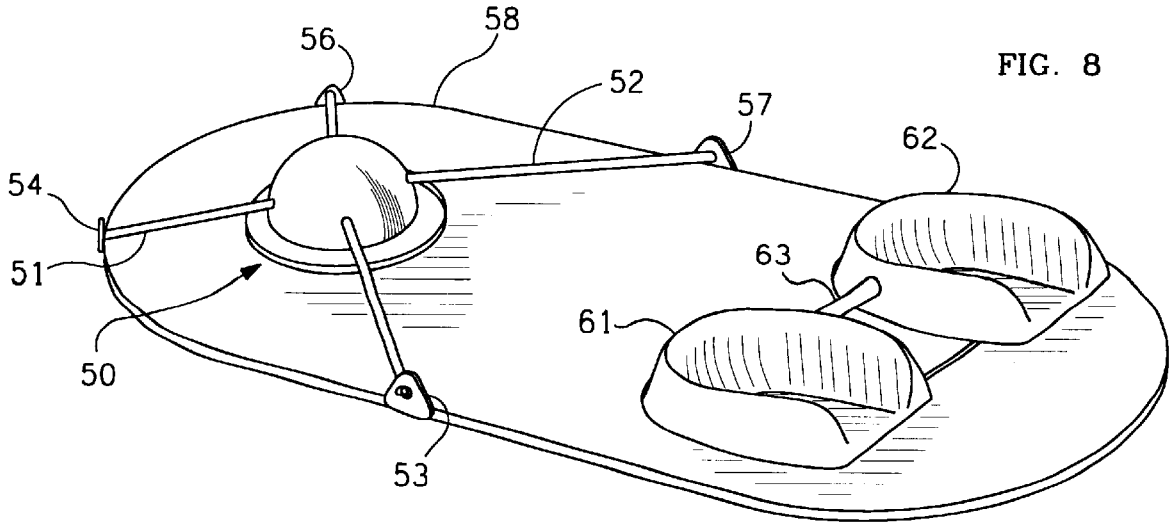
FIG. 8 is a perspective view of a shoulder exerciser attached to a platform and having pivotable knee pads attached thereto for exercising the trunk muscles along with the shoulder muscles.

Referring to FIG. 8, there is shown a shoulder exerciser generally designated as 50 which has a plurality of resilient members 51 and 52 which are attached to a plurality of clips 53, 54, 56 and 57 which are connected to a platform 58. While the clips are not shown in detail, it is contemplated that they each have either a pair of slots or some other means to allow adjustment of tension in the resilient members. Instead of a platform, the clips could be adapted to be used on a table. Alternatively, the platform 58 could have a first pair of slots 80 and 81 formed in one position in the platform and a second pair of slots 82 and 83 formed in a second position in the platform to accommodate a shoulder exerciser with one elongated resilient member of the type shown in FIG. 2. Other adjustment facilities could also be used for one or more resilient members. In use, a user would kneel on the platform and move the shoulder exerciser 50 in a the prescribed motion to get the desired exercise. Additionally, the platform 58 may have attached thereto a pair of pivotable knee pads 61 and 62, preferably padded, each of which is mounted to swivel independently of each other relative to the platform to allow the user 's trunk to swivel during the shoulder exercises. This permits lateral side flexion exercise of the lower back. The knee pads may be interconnected by a resilient member 63 to provide resistance during turning. There are muscles which span both the shoulder and the back combined, such as the latissimus dorsi. These muscles are extremely important to be able to be exercised both at their origin and their insertion, which are the two points of attachment of the muscles. The use of the shoulder exerciser in combination with the pivotable knee pads allows such muscles to be exercised.

In use, the shoulder exerciser can be used in either a passive or an active mode. If used in an active mode, the affected shoulder will be exercised directly by placing the related hand on the handle or handpiece of the shoulder exerciser and moving it in a prescribed motion against the resistance. If motion in a passive mode is desired, the unaffected side of the body can be used so that there will be little or no resistance against the affected side; i.e., if the right shoulder is affected, the left hand can be put onto the handpiece along with the right hand and the left hand can take most or all of the force thereby carrying the right hand along so that little resistance is felt by the affected right shoulder, or vice versa.

Although the present invention has now been described in terms of certain preferred embodiments and exemplified with respect thereto, one skilled in the art will readily appreciate that various modifications, changes, omissions and substitutions may be made without departing from the spirit and scope thereof. It is intended that the present invention be limited solely by the scope of the following claims.

What is claimed is:

1. A shoulder exerciser comprising:

a handpiece having a flat bottom portion for sliding on a surface of a door and an upper portion for receiving one or both hands of a user in a position adjacent to said surface of the door, said handpiece having a hollow cavity which can be filled with a fluid material to add weight to the handpiece to increase the force required to exercise the shoulder;

one or more resilient members attached to said handpiece; and means for connecting said resilient member to the upper corners of the door so that said handpiece is moveable in any direction along said surface by a user to exercise the shoulder against the resistance of the resilient members.

2. A shoulder exerciser as set forth in claim 1 wherein said handpiece has a removable closure for said cavity.

3. A shoulder exerciser comprising:

a platform adapted to rest on the floor;

a handpiece having a bottom surface for sliding on the upper surface of the platform;

a plurality of resilient members connected to said handpiece and to said platform so that said handpiece is moveable in any direction along the surface of said platform by a user kneeling on the platform to exercise the user's shoulder in a prescribed manner; and a pair of knee pads pivotally mounted to the platform for supporting the knees of the user and allowing rotation of the user's trunk while performing shoulder exercises.

4. A shoulder exerciser as set forth in claim 3 wherein said pair of knee pads are interconnected by one or more resilient members.

5. A shoulder exerciser as set forth in claim 3 wherein said handpiece is dome shaped to accommodate one or both hands of a user.

6. A shoulder exerciser comprising:

a handpiece having a flat bottom portion for sliding on a surface of a door and an upper portion for receiving one or both hands of a user in a position adjacent to said surface of the door, said upper portion being dome shaped and having a plurality of passageways formed therein;

a pair of resilient members each passing through one of the passageways of said handpiece; and means for connecting each end of said resilient member to a corner of a door so that said handpiece is moveable in any direction along said surface by a user to exercise the shoulder against the resistance of the resilient member.

7. A shoulder exerciser comprising:

a handpiece having a flat bottom portion for sliding on a surface of a door and an upper portion for receiving one or both hands of a user in a position adjacent to said surface of the door;

one or more resilient members attached to said handpiece;

means for connecting said resilient members to the upper corners and bottom corners of the door so that said handpiece is movable in any direction along said surface by a user to exercise the shoulder against the resistance of the resilient members, said connecting means comprising a pair of plates adapted to be positioned on either side of a corner of the door, each plate having a plurality of slots therethrough, and a web passing through the slots and interconnecting the first plate to the second plate, at least one plate having an opening therethrough for receiving and securing an end of said resilient member.

8. A shoulder exerciser comprising:

a platform adapted to rest on the floor;

a dome shaped handpiece having a bottom surface for sliding on the upper surface of the platform, said handpiece having a hollow cavity and a removable closure for allowing weight to be added to the handpiece; and a plurality of resilient members connected to said handpiece and to said platform so that said handpiece is moveable in any direction along the surface of said platform by a user kneeling on the platform to exercise the user's shoulder in a prescribed manner.

* * * * *